169-46 SR

9/25/79 OR 4,168,748

United States Patent [19]

Batte

[11] 4,168,748

[45] Sep. 25, 1979

[54] FIRE CONTROL AND EVACUATION SYSTEM

[76] Inventor: Christopher L. Batte, 7816 Purdue, Dallas, Tex. 75225

[21] Appl. No.: 895,988

[22] Filed: Apr. 13, 1978

[51] Int. Cl.[2] ..... A62C 3/14

[52] U.S. Cl. ..... 169/46; 169/61; 169/70; 340/289

[58] Field of Search ..... 169/43, 46, 52, 60, 169/61, 70; 340/289; 187/6; 239/271; 182/19, 38, 87, 144, 148–150

[56] References Cited

U.S. PATENT DOCUMENTS

| | | | |
|---|---|---|---|
| 2,857,005 | 10/1958 | Medlock | 239/271 X |
| 3,820,606 | 6/1974 | Terayama | 239/271 X |
| 3,865,194 | 2/1975 | Chatfield, Jr. | 239/271 X |
| 3,945,469 | 3/1976 | Dorcich | 187/6 |
| 4,042,066 | 8/1977 | Noone | 187/6 |

*Primary Examiner*—Joseph J. Rolla
*Assistant Examiner*—Fred A. Silverberg
*Attorney, Agent, or Firm*—Crisman & Moore

[57] ABSTRACT

A method and apparatus for instantaneous response, evacuation and control of a fire in a conventional multistory building, having substantial side wall portions formed of glass or brick. A suspendable and/or connectable personnel platform is provided with telescoping fire suppressant nozzles adapted for coupling to a fire suppressant supply system constructed in the corners and/or side walls of a building. A computerized control network facilitates fire detection and remote actuation of the system and positioning of the platform at the necessary building level. The platform includes a cage for the protection of the evacuees of the particular floor of the building being serviced. In addition, the platform includes a horizontal supply line which couples to the building fire suppressant supply system for permitting the telescoping nozzles to spray the subject combustion. Each nozzle includes a mechanism for positioning the fire suppressant nozzles within the building by cutting through the glass sides thereof and spraying fire suppressant upon the fire therein. The system is also provided with a smoke and fume ventilation system whereby toxic by-products of the fire may be immediately evacuated from the floor of the building. Similarly, an evacuee signal response system is provided for use in conjunction with the telescoping nozzles for selectively breaking out adjacent glass windows to provide a way for personnel egress to the platform. In this manner, the response time to combat a building fire may be substantially reduced through preprogrammed automation and the problem of personnel evacuation substantially eliminated.

11 Claims, 7 Drawing Figures

FIRE CONTROL AND EVACUATION SYSTEM

BACKGROUND OF THE INVENTION

The invention relates to fire control and evacuation devices and, more particularly, to a system of telescoping fire retardant nozzles constructed in a suspendable personnel platform elevatable along the side of a high rise building for combating fire at any level thereof.

The conventional method of fighting and suppressing a fire in a high rise building is with built-in sprinkler systems and/or fire department personnel. Sprinkler systems have found much disfavor from aesthetic and economic standpoints. Usually, fire fighting equipment and men are simply rushed to a building in response to a fire alarm for extinguishing the combustion and extracting of survivors from the effected building levels. This conventional method is inefficient from the multiple standpoints of delay time between detection of the fire, effective personnel evacuation and adequate provision of suitable fire suppressant materials at high levels of the building. Occasionally, the location of the fire is an upper level of the building from which it is difficult, if not impossible, to simultaneously fight the fire and vacate trapped personnel.

Many conventional high-rise buildings are now constructed with glass window curtains comprising the bulk of the outside walls. The presence of such massive amounts of glass at such enormous heights renders inoperable conventional fire fighting techniques and equipment such as the historical hook and ladder truck. The glass, if at a low enough level, must first be broken to permit access. However, random glass shattering inwardly can seriously injure panic-stricken occupants. This problem is essentially negated by the fact that above certain levels outside access by fire fighters is virtually impossible by prior art methods. Fire department personnel must then rely on the elevator system of the building to provide access to higher levels and even then a fire on an intermediate floor can cut off access to an upper floor. In view of the established fact that sprinkler systems are not utilized in such skyscrapers for aesthetic and related reasons, the occurrence of a high level fire can be catastrophic.

It would be an advantage, therefore, to overcome certain of the problems, inconveniences and hazards of prior art apparatus and methods by providing an improved fire control and evacuation system which can be incorporated directly in conjunction with a highrise building. The fire control and evacuation system of the present invention is especially adapted for use in conjunction with "glass" skyscrapers and for fire occurring at any level of the building. An outside suspension platform is thus provided atop the building with means for safely piercing glass walls with automated fire suppressant nozzles. In this manner the magnitude of property damage can be reduced, trapped persons evacuated and the formidable fire hazard of modern skyscrapers substantially eliminated.

SUMMARY OF THE INVENTION

The invention relates to methods and appratus for use in conjunction with high rise buildings for the evacuation of the occupants and the combating of fire therein. The apparatus includes a network of supply piping constructed within the side walls of the building and a suspension platform for selective coupling engagement with the supply piping at the necessary floor level. The platform is comprised of a housing for evacuees and a horizontal supply line having a plurality of telescoping nozzles extending therefrom. Each nozzle includes means for automatically piercing a glass wall and spraying fire suppressant supplied under pressure in the building supply network.

In another aspect of the invention there is provided with the aforesaid suspension platform, means facilitating personnel evacuation. The evacuation means includes expandable arms which selectively project in a predefined radial pattern about the nozzle disposed in the building for breaking a section of the glass and providing an escape route to the platform for evacuees. The expandable arms deploy in response to a manual signal mode available to trapped persons on the building floor being serviced during the fire. An audible and visual signal indicates to the evacuees the availability of egress while the same nozzles are combating the combustion in their vicinity. Therein, each nozzle has a small but powerful light bulb/or bulbs that emit a bright light for evacuees to hone in/focus on for quicker response and rescue by the system.

The overall system is linked to a computerized network and the detection of fire victims is automatically signaled to the associated fire fighting team. Additionally, the normal automated operation of the nozzles may be altered into an evacuation mode wherein the telescoped nozzles withdraw with deployed arms, breaking away the adjacent glass and providing an escape route to the platform.

In yet another aspect of the invention, the spray nozzles are constructed with a rotational cutter, driven by the ejection of fire suppressant therefrom or $CO_2$ cartridges, inside the nozzle. The fire suppressant is supplied to the cutter from the horizontal supply line of the platform and adjacent floor. The system also permits immediate flow reversal when toxic fumes are "detected" in the vicinity of evacuees.

In one further aspect of the invention, a heat sensor is incorporated into the end of the nozzle and associated system for establishing a controlled means for detecting the actual combustion. The sensor facilitates maximum utilization of the associated computer for inputting combustion magnitude and location. In addition, the nozzle may include sealant means for patching the ingress hole in the glass as the nozzle retracts. Driven by a $CO_2$ cartridge, if necessary, in this manner, fanning drafts can be eliminated in areas where the fire has not been completely suppressed. Because the system is automated, geared toward personnel evacuation, and reduces collateral property damage, its cost effectiveness may be accentuated relative to antiquated non-automated systems.

BRIEF DESCRIPTION OF THE DRAWINGS

Fore a more complete understanding of the present invention and for further objects and advantages thereof, reference may now be had to the following description taken in conjunction with the accompanying drawings in which.

DETAILED DESCRIPTION

Figure 1:
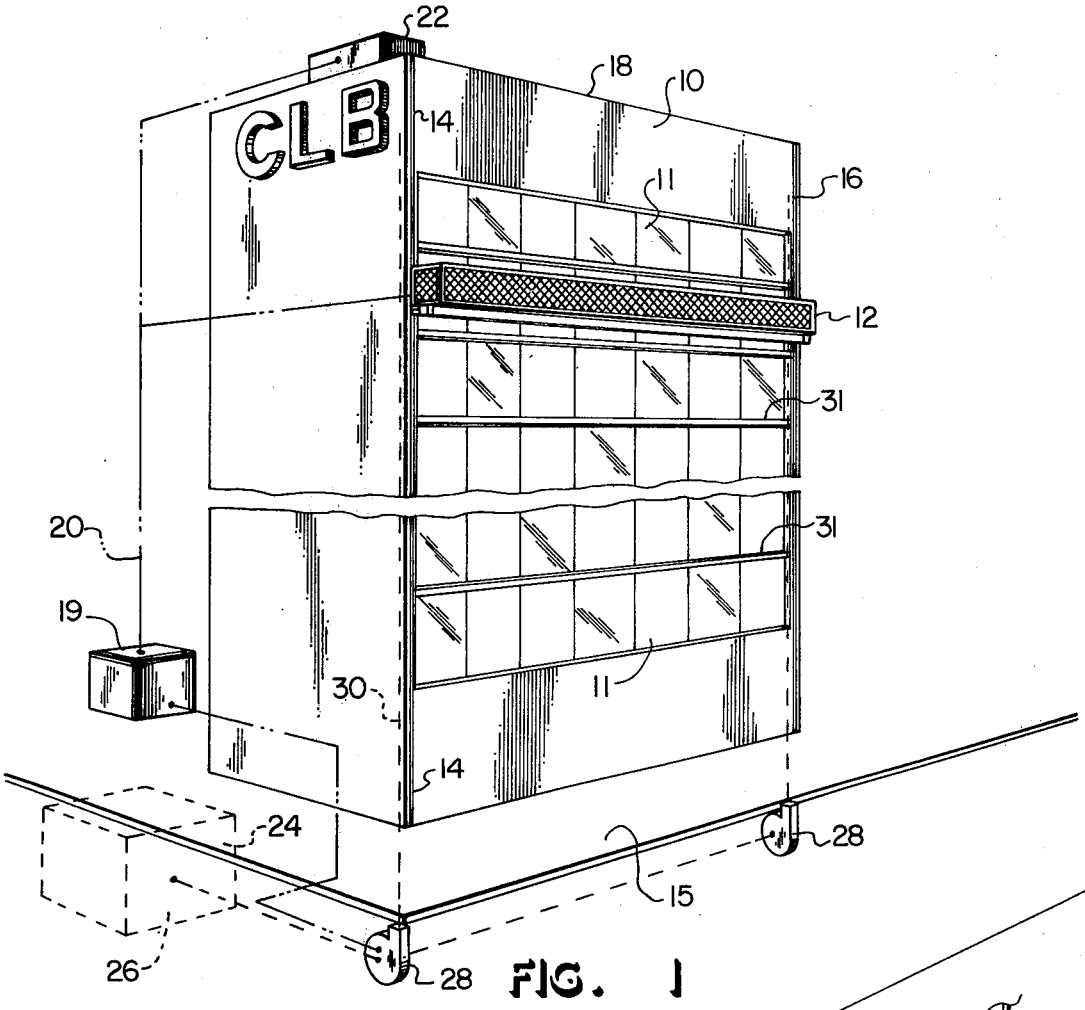
FIG. 1 is a perspective view of a building incorporating the fire control system of the present invention.

Referring first to FIG. 1, there is shown a perspective view of a conventional multi-story building 10, having substantial side wall portions formed of glass 11. The high rise structure 10 has secured thereto, an evacuation carriage 12 suspended alongside said building through interconnection means coupled to tracks 14 and 16 constructed therein. The suspension carriage 10 is likewise coupled to a computer 19 and computerized network 20 incorporated into the building power system for diagnosing and combating combustion occurring therein. In this manner, a high rise building of any height and configuration may be effectively and automatically serviced during times of emergency to prevent substantial property damage and human loss, as will be defined in more detail below.

Still referring to FIG. 1, there is shown a diagrammatical representation of the computer 19 and system 20 integrally linked with the building 10 and carriage 12. A secondary remote computer terminal 22 is located on the roof 18 of the building 10 for controlling the location of carriage 12 along the side or front of the subject structure, should the base computer 19 be knocked out by an intermediate fire. The computerized network 20 is coupled to both computers and controls a fire suppressant supply system 24 including fire suppressant reservoir 26 and pump units 28. The system 24 is preferably provided beneath the building 10. A network of tubing 30 (diagrammatically shown), is provided within the side walls of the building for supplying fire suppressant to each floor 31 of subject structure. The supply tubing 30 is located about the building 10 adjacent the glass 11 for requisite coupling to the suspension carriage 12 to facilitate the combating of fire occurring within the building 10 at any level.

Figure 2:
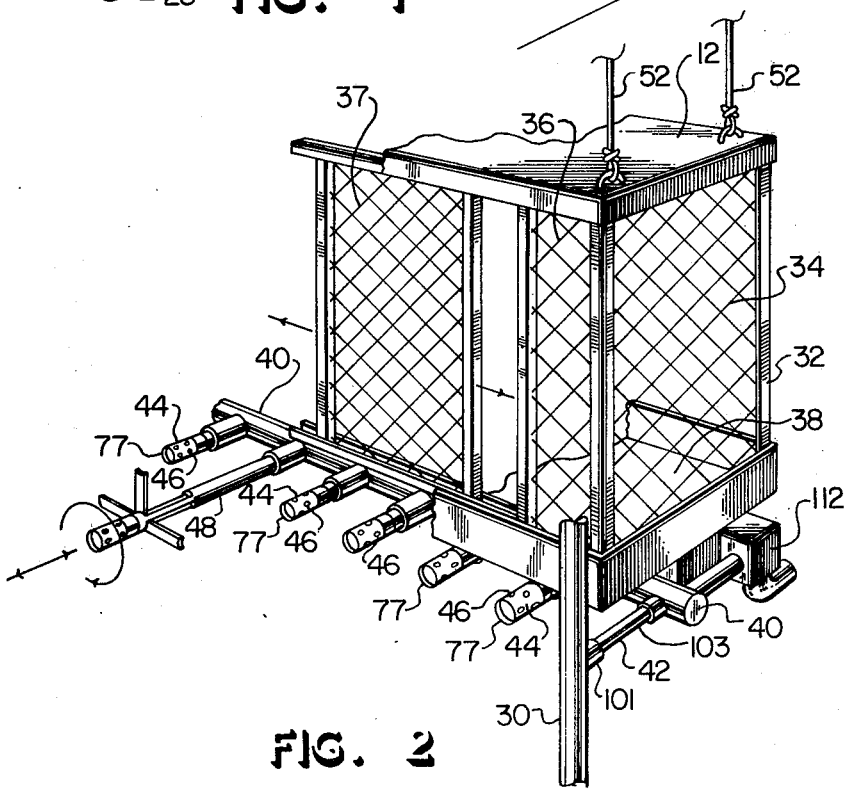
FIG. 2 is an enlarged, perspective, fragmentary view of the suspension carriage of the present invention illustrating a plurality of telescoping members extending forwardly thereof.

Referring now to FIG. 2, there is shown a large fragmentary view of the suspension carriage 12. The carriage 12 includes an enclosure 32 comprised of wire screen 34 or the like, formed substantially therearound for protecting evacuees entering therein from building 10. The frontal section 36 of the carriage 12 is constructed with a plurality of sliding gates 37 for facilitating the entry and safety of egressing personnel. Beneath the floor 38 of the carriage 12, there is provided a generally horizontal flow pipe, or conduit 40, continuing the length of the floor 38. The elongate conduit 40 includes coupling apparatus 42 at each end for connecting with the fire suppressant supply network 30 at discrete positions therealong. Coupling apparatus 42 is preferably of a "plug in" variety, including an insertable conduit which mates with the select plug of the tubing 30 for facilitating emergency interconnection at any level of the building 10.

The coupling apparatus 42 permits rapid interconnection between the conduit 40 and the fire suppressant system 30 of the building 10. The interconnection may be effected by a "plugging" action of the type commercially available today for smaller hose couplings. In such apparatus a spring biased, female outer ring coupling 101 moves axially to permit receipt and sealing of a male coupling, 103 generally having a circumferential necked area of reduced cross section (not shown). Such a plug facilitates a quick hook-up which is integral to effectiveness of the present invention. Other types of coupling apparatus are also contemplated such as an electromagnetic actuated male coupling 103 which responds to sensor units disposed upon the system 30 to engage a mating coupling 101 when aligned therewith. These particular embodiments are not shown in detail since such components are commercially available and readily incorporated by those skilled in the art. It should also be seen that more conventional threaded couplings are contemplated when used in conjunction with adjacent valve apparatus (not shown) disposed in the system 30.

Still referring to FIG. 2, there is shown a plurality of fire suppressant nozzles 44 which may be flexibly mounted for extending forwardly of the conduit 40. The fire suppressant nozzles 44 each includes a plurality of angulated orifices 46 disposed circumferentially therearound for ejecting fire suppressant pumped therethrough. The fire suppressant sprayed from the orifices 46 is also utilized to impart rotational movement to the nozzles 44 for the piercing of the glass walls 11, as will be defined in more detail below.

Figure 7:
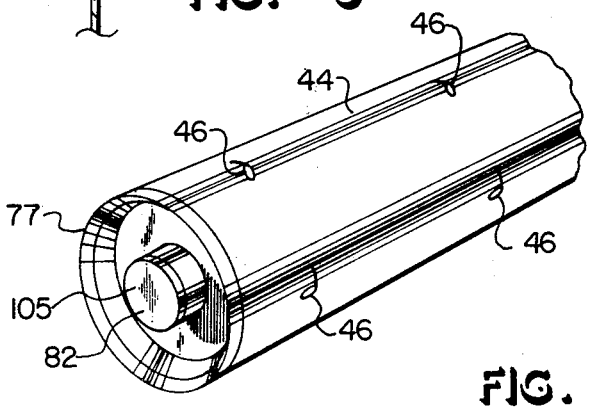
FIG. 7 is an enlarged, perspective view of a fire suppressant nozzle constructed for piercing the glass wall of a building in conjunction with the present invention.

Referring now to FIG. 7, there is shown a nozzle 44, having installed therein a circular diamond cutting bit 77 on the end thereof. The bit 77 circumferentially encloses an electronic sensor-alarm package 82 recessed therein. The angulated orifices 46 cause the nozzle 44 to rotate concommitantly with the bit 77. As the nozzle 44 rotates in engagement with the glass 11, said glass is pierced to permit said nozzle to enter therein. The sensor-alarm package 82 facilitates effective coordination of this manuever. The package 82 includes a heat sensor 105 which detects the presence of fire through the glass 11 and then signals the computer 19 when said fire is extinguished. When the water, or fire suppressant pressure is then shut down the package 82 broadcasts instruction to persons in range thereof through a speaker that evacuation is possible. Speaker (not shown) may be assembled adjacent the sensor 105 and operated via the computer 19. In this manner life as well as property may be saved.

Referring again to FIG. 2, each of the nozzles 44 of the carriage 12, is constructed with telescoping support sections 48 for permitting each nozzle 44 to extend forwardly, against and through the building 10. A nozzle 50 is thus shown extended beyond the adjacent nozzles 44 for purposes of illustration in FIG. 2. The nozzle 50, in this position is in a configuration for ejecting fire suppressant upon adjacent combustion as well as selectively breaking out portions of the glass wall of the building 10 to provide for personnel evacuation, as will also be described in more detail below.

Figure 3:
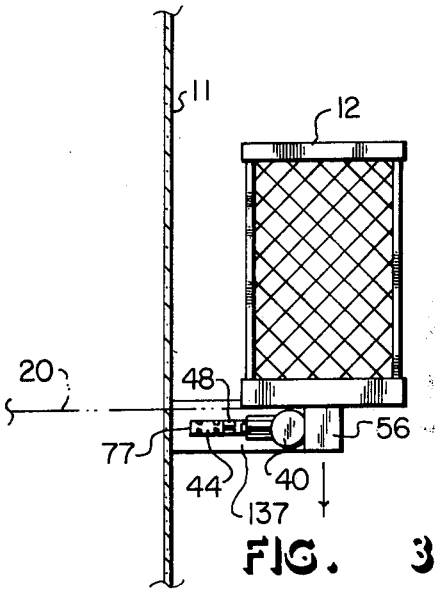
FIG. 3 is a side elevational, diagrammatical view of the suspension carriage of FIG. 2 adjacent the side wall of a building preparatory to the combating of combustion therein.

Referring now to FIGS. 3 through 6, there is shown four stages of fire control and personnel evacuation provided in accordance with the principles of the present invention. Referring first to FIG. 3, the carriage 12 is constructed to be suspended along the side or front wall of the building 10 by engagement with support tracks 14 and 16. The tracks 14 and 16 extend from the ground 15 to the roof 18 of said building for permitting rectilinear movement of the carriage 12 thereon. A conventional cantilever coupling 137 and elevator drive apparatus (not shown) is provided for carriage support. Such apparatus is currently utilized in certain window washing platforms. It should be understood that the operation of the carriage 12 as described herein is specifically adapted for engagement with glass window curtains along the side or front of the structure. A side elevational view of the carriage 12 illustrates the end of the conduit 40 and the forward disposition of the nozzles 44 mounted upon telescoping arms 48 extending forwardly of said conduit. A longitudinal support beam 56 is secured beneath the lower floor 38 of carriage 12 for the structural support of the conduit 40 and the remote actuation of the nozzles 44.

Figure 4:
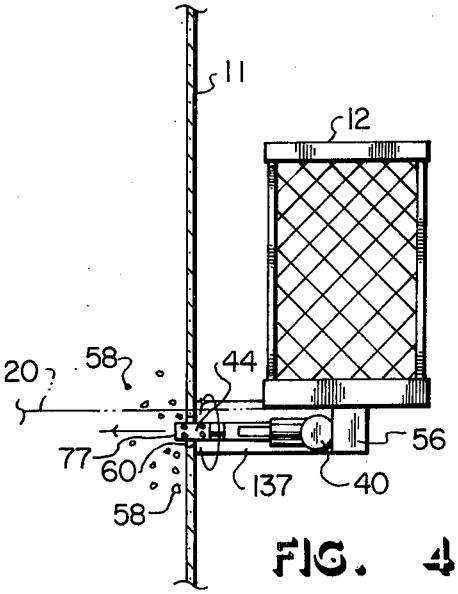
FIG. 4 is a side elevational view of the carriage of FIG. 3, illustrating one of the telescoping members piercing the glass wall of the building preparatory to combating of combustion therein.

Referring now to FIG. 4, there is shown the extension of a nozzle 44 through the glass wall 11, while carriage 12 remains suspended adjacent thereto. The nozzle 44 is formed to cut a small opening in the glass 11. Because of the small size of the nozzle 44, the glass fragments 58 are relatively small, and the aperture 60 formed therethrough is of minor import. In this manner, the actual fire is accessible in an automated fashion, with negligible time loss.

Figure 5:
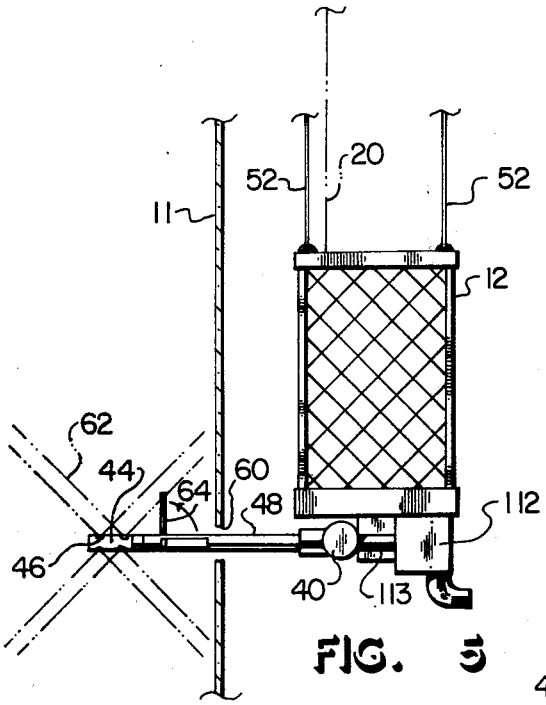
FIG. 5 is a side elevational view of the suspension carriage of FIG. 3, illustrating the ejecting of fire suppressant substance within the building to combat combustion and deploying a radial arm for facilitating personnel evacuation therefrom.

Referring now to FIG. 5, the carriage 12 is shown disposed adjacent the glass sidewall 11 with the conduit 40 supplying fire suppressant, such as water through the telescoping arms 48 of the nozzle 44. The ejection of water is shown by phantom lines 62 forming an angulated pattern within the sidewalls 54. The emission of fire suppressant in this manner has been shown to be an effective means for engaging building fires within the vicinity of the outer glass wall 11 thereof. The result is much more effective than that of conventional sprinkler systems used in the past. The emission of fire suppressant 62 in the automated fashion shown herein is an equally effective means for providing an escape route for trapped personnel. Those persons being entrapped within the building 10 may find refuge in the area effectively served by the nozzle 44. Upon reaching said nozzles, the occupants may signal the computer 19 by dector means disposed therearound to cause the deployment of an array of radial arms 64 around the telescoping support section 48. The actual sensor for effecting this deployment may be of any conventional design although a preferred embodiment will be described in more detail below. The arm deployment permits the the trapped occupants to egress to the carriage 12, disposed outwardly of the glass 11 by facilitating the breakage thereof in an automated fashion.

Figure 6:
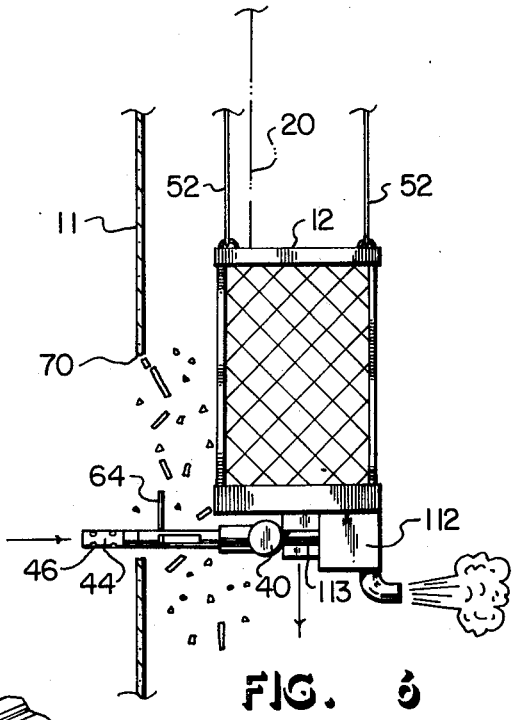
FIG. 6 is a side elevational view of the suspension carriage of FIG. 3 with the telescoping arm being withdrawn through the side wall of the building and breaking a section thereof away to facilitate personnel evacuation.

As shown in FIGS. 5 and 6, an alternative embodiment of a carriage support system is shown, comprising suspension cables 52. In this manner, older buildings not equipped with tracks 14 and 16 may incorporate the present invention with a conventional cable system (not shown). The installation of the tubing 30 and computerized network 20 has been shown to be possible in existing structures.

Additionally, FIGS. 5 and 6 illustrate an exhaust fan 112 disposed in communication with the conduit 40 through a valve 113. In one mode fire suppressant from the system 30 travels through the pipe 40. In a second, exhaust mode described below, the valve 113 shuts off the fire suppressant and exhausts the pipe 40 and nozzles 44 with forced air. The exhaust fans 112 are secured at opposite ends of the carriage 12 to act in unison.

Referring now to FIG. 6, there is shown the carriage 12 disposed outwardly of the glass wall 11, wherein the nozzle 44 is being retracted back toward the conduit 40. The radial arm 64, upon engaging the glass 11 about the aperture 60 formed therein, breaks said glass outwardly and fragments said glass to provide egress of the occupants into the carriage 12. This event is triggered in response to signals received from the trapped occupants signalled by the sensor-alarm package 82 discussed above in a manner described below. In addition, a secondary fire control system is preferably incorporated during this personnel evacuation step in the operation. The secondary method may include the aforesaid forced ventilation or exhausting of the subject premises through the nozzles 44 in conduit 40, wherein toxic fumes are quickly removed.

In operation, the invention described herein permits the instantaneous control of a fire in a multi-story building of any configuration and size, while providing for evacuation of trapped occupants therein. The aforesaid fire control and evacuation procedures are not currently available as set forth in the background of the invention above. To provide the fire control effectiveness described above, the vertical pipes 30 are disposed within the sidewalls at corners of building 10 adjacent the glass wall portions 11. Each floor 31 of the building 10 must also incorporate an access coupling for interconnection with the supply conduit 40 of the carriage 12.

When fire is detected, the computer network 20 enters its response mode and activates the positioning mechanism of the carriage 12 adjacent the select floor 31. The horizontal pipe 40 then plugs into the building supplying tubing 30 through the coupling means 42 provided therebetween. Suitable coupling is provided at every floor 31. The fluid supply pump 26 of the system 24 then provides said system with fire suppressant under pressure, filling the horizontal conduit 40 therewith. The fire suppressant expands the nozzles 44 through support arms 48 into the glass sidewalls 11. The ejecting suppressant from the angulated orifices 46 causes the nozzles to rotate, similar to conventional lawn sprinklers. The spinning nozzles then cut the glass 11 by means of the diamond cutting bits 77 constructed within the end of the nozzle 44. It should be noted that electromechanical auxiliary drive systems (not shown) may also be incorporated to effect piercing of the wall, or appropriate $CO_2$ cartridges.

When the nozzles 44 have entered the building 10 and delivered a spray of fire suppressant, occupants therein are notified by the sensor-alarm package 82. The alarm may include the aforesaid taped message as well as a flashing light (not shown) and/or bell (not shown) to signal semi-conscious occupants. The bells and lights are located on the expandable arms 64. Each arm 64 is constructed to be depressed by an evacuee acting in response to the taped message. The depression of an arm 64 signals the computer 19 of evacuees and the radial arm array then deploys, as illustrated in FIGS. 2 and 5. The deployment or extension of arm 64 prevents the retraction of the nozzle 44 without breaking an enlarged section of the glass wall 11. As the nozzle 44 withdraws under computer command to the carriage 12, the extension arm 64 breaks a sufficient crescent area of the glass wall 11 to provide means of egress for trapped occupants. Occupants within the carriage 12 may then actuate appropriate control elements to lower the carriage 12 to the ground for rescue. All necessary first aid facilities are provided within the rescue cage.

The response time for personnel evacuation following the combatting of combustion within the building 10 as described herein is heretofore unprecedented. The "alert" status of fire suppressant system 24 facilitates this effectiveness. The vertical conduit 30 of the system 24 may be coupled to the carriage 12 at any point along the system. The coupling mechanically isolates any portion of the system thereabove for maximizing fluid pressure therein. Additionally, the fluid within the nozzles 44 can be drained in a matter of seconds, which drainage will then permit evacuation of fumes within the building floor and ventilation of same to remove dangerous gases from air pump 112 disposed underneath the escape cage. The air pumps 112 are connected to the conduit 40 and extension arms 48. When the sensor package 82 detects no fire and/or when evacuation signals are imparted to the computer 19, the conduit 40 is automatically valved to exhaust the building 10. The pumps 112 quickly facilitate this operation and direct exhaust fumes outwardly of the carriage 12.

In an alternative embodiment, each nozzle is provided with means to seal the drilled hole it created, by the provision of a fire proof poly urethane mat deposited at the hole 60 during retraction of the nozzle back through the hole 60. The fiberglass is deposited to form a "patch" during the retraction, in place of breaking the glass 11 by the radial arm 64. The patch prevents airflow back into the burning area 21, which could result in a flashback, or regeneration of the combustion therein. The elimination of said draft is important to prevent dangerous secondary fires.

Having described the invention in connection with certain specific embodiments thereof, it is to be understood that further modifications may now suggest themselves to those skilled in the art, and it is intended to cover such modification as fall within the scope of the appended claims.

I claim:

1. A method of combating fire with a fire suppressant substance in a multi-story building having substantial side wall portions formed of glass and simultaneously providing means for the prompt evacuation of the occupants, or rescuees of said building during said fire, said method comprising the steps of:

providing a suspension carriage adjacent the side of the building, said carriage comprising an elongated structure constructed for receiving evacuees therein and providing means for fighting the combustion within said building;

providing a fire suppressant supply network about the building for communication with said suspension carriage;

positioning said carriage adjacent the select floor of the building requiring fire control;

coupling said carriage to said fire suppressant supply network;

providing glass piercing members about said carriage for extending from said carriage and engaging said glass side walls of said building;

mounting said glass piercing members on extendible telescoping members constructed in said carriage;

projecting said telescoping members and glass piercing member through said glass wall of said building;

ejecting fire suppressant from said telescoping members into the building to smother the fire;

retracting said telescoping members from within the building back into said carriage;

breaking sections of the glass wall of said building outwardly during the retracting of said telescoping members for permitting evacuation of occupants therein into said carriage;

permitting said occupants to enter said carriage disposed adjacent said broken glass wall of said building; and lowering said carriage to the ground for the evacuation of said evacuees.

2. The method as set forth in claim 1 wherein said telescoping members are provided with a plurality of retractable, radially extending arms and said step of breaking the glass wall of the building outwardly includes the step of selectively extending the arms of said telescoping members outwardly for engaging the inside wall of the glass and causing a section of the glass to break outwardly.

3. The method as set forth in claim 2 wherein the step of causing said radially extending arms to selectively extend outwardly includes the steps of providing a sensor upon said telescoping arm for receiving a signal from a building occupant in the vicinity thereof and manually signaling said sensor to deploy said arms outwardly for permitting the evacuation of said occupants.

4. The method as set forth in claim 1 wherein the step of coupling said carriage to said fire suppressant system of said building includes the steps of providing said carriage with a fluid flow member along the length thereof and plugging said fluid flow member into said fire suppressant system of said building.

5. The method as set forth in claim 1 wherein the step of piercing the glass walls of the building includes the step of rotating the glass piercing members of said carriage and drilling through the glass walls.

6. The method as set forth in claim 5 wherein the glass piercing members are disposed on the end of the telescoping members and said rotation thereof for drillinbg through said glass includes the step of driving said rotation with the pressure of the fire suppressant being ejected from said telescoping members.

7. The method as set forth in claim 1 wherein the telescoping members each include a sensor package including an alarm system therein and the step of breaking said glass wall includes the step of signaling to the occupants of the building the availability of evacuation through said glass wall.

8. The method as set forth in claim 7, wherein the step of retracting said telescoping members from the building includes the step of providing a sensor upon said telescoping arm for receiving a signal from a building occupant that evacuation into said carriage is desired.

9. The method as set forth in claim 1 and including the step of providing a computerized control system and wherein the fire suppressant system of the building and the positioning of said carriage and actuation thereof is coupled to said computerized control system for providing emergency fire control therefor.

10. The method as set forth in claim 1 wherein the step of ejecting fire suppressant from said telescoping members includes the step of terminating fire suppressant ejection; withdrawing fire suppressant from said fire suppressant supply network, and ventilating said portion of said building through said telescoping members.

11. Apparatus for combating fire with a fire suppressant substance in a multistory building having substantial side wall portions formed of glass and simultaneously providing means for the promp evacuation of the occupants, or rescuees of said building during said fire, said apparatus comprising:

an evacuation carriage suspendable adjacent the side of the building, said carriage comprising an elongated structure for receiving evacuees therein and providing means for fighting the combustion within said building;

a fire suppressant supply network constructed within the building;

means for coupling said carriage to said fire suppressant supply network;

glass piercing members provided about said carriage for engaging said glass side wall of said building;

said glass piercing members being mounted on extendible telescoping members constructed in said carriage;

said telescoping members and glass piercing member being projectable through said glass wall of said building for ejecting fire suppressant from said telescoping members into the building to smother the fire;

said telescoping members being retractable from within the building back into said carriage and including means for breaking sections of the glass wall of said building outwardly for permitting evacuation of occupants therein into said carriage for permitting said building occupants to enter said carriage disposed adjacent said broken glass wall of said building; and means for lowering said carriage to the ground for the evacuation of said evacuees.

* * * * *